US005433599A

United States Patent [19]

Van Laar et al.

[11] Patent Number: 5,433,599

[45] Date of Patent: Jul. 18, 1995

[54] CERAMIC BURNER FOR A HOT-BLAST STOVE OF A BLAST FURNACE

[75] Inventors: Jacobus Van Laar, Driehuis; August H. Hendriks, Koog aan de Zaan; Rudolf Boonacker, Beverwijk; Johannes C. A. van den Bemt, Schagen; Jean-Pierre A. Westerveld, Amsterdam, all of Netherlands

[73] Assignee: Hoogovens Groep B.V., Ijmuiden, Netherlands

[21] Appl. No.: 28,357

[22] Filed: Mar. 10, 1993

[30] Foreign Application Priority Data

Mar. 16, 1992 [NL] Netherlands ..... 9200486

[51] Int. Cl.[6] ..... F24H 1/00

[52] U.S. Cl. ..... 431/181; 431/8; 431/159

[58] Field of Search ..... 431/8, 10, 181, 187, 431/188, 161, 162, 163, 166, 159, 350, 9; 432/217, 181, 222

[56] References Cited

U.S. PATENT DOCUMENTS

| | | | |
|---|---|---|---|
| 1,754,603 | 4/1930 | Brown | 431/181 |
| 2,049,150 | 7/1936 | Bencowitz et al. | 431/161 X |
| 3,044,539 | 7/1962 | Keating et al. | 431/10 |
| 4,217,088 | 8/1980 | Reed | 431/163 X |
| 4,402,666 | 9/1988 | Glomm et al. | 431/177 |
| 4,642,047 | 2/1987 | Gitman | 431/10 X |
| 4,797,087 | 1/1989 | Gitman | 431/10 |
| 4,863,378 | 9/1989 | Felthuis et al. . | |
| 4,881,895 | 11/1989 | Felthuis et al. | 431/158 X |
| 4,933,163 | 6/1990 | Fisher et al. | 431/10 X |
| 4,946,475 | 8/1990 | Lipp et al. | 48/86 R |

FOREIGN PATENT DOCUMENTS

| | | | |
|---|---|---|---|
| 0306072 | 3/1989 | European Pat. Off. . | |
| 2536073 | 3/1976 | Germany | 431/187 |
| 3240852 | 5/1984 | Germany . | |
| 4217704 | 8/1992 | Japan | 431/161 |
| 2048456 | 12/1980 | United Kingdom | 431/10 |
| 0723299 | 3/1980 | U.S.S.R. | 431/187 |

OTHER PUBLICATIONS

"Optimierung der Brenner von Winderhitzern im Hinblick auf einen hohen CO-Ausbrand" Stahl und Eisen, 110, 1990, Nov., No. 11, pp. 41-50.

*Primary Examiner*—Carl D. Price

*Attorney, Agent, or Firm*—Stevens, Davis, Miller & Mosher

[57] ABSTRACT

A ceramic burner for a hot blast stove has a central gas duct that opens into the central zone of a burner crown and side air ducts on both sides of the gas duct which also open into the central zone. To improve combustion characteristics, there is a central air duct in the gas duct opening out within it. Air is supplied to the central air duct in an upward flow which exits in two opposing directions through side openings.

8 Claims, 2 Drawing Sheets

CERAMIC BURNER FOR A HOT-BLAST STOVE OF A BLAST FURNACE

BACKGROUND OF THE INVENTION

1. Field of the Invention

The invention relates to a ceramic gas burner for a hot-blast stove of a blast furnace. Typically, such a burner has central gas duct that opens into a central zone of a burner crown and side air ducts on both sides of the gas duct which also open in the central zone. The invention also relates to a method for operating such a ceramic burner.

2. Description of the Prior Art

Hot blast stoves, which act as regenerative heat exchangers for the heating of blast air for a blast furnace, are well known. A burner as described above is known from European patent specification EP-A-0306072. In this known burner, the relative positioning of the outflow openings of the gas and air ducts, together with recesses formed by grooves in the long sides of the outflow openings, is intended to lower the point where the mixing turbulence is complete. This has a positive effect on the stability of the flame as well as the uniformity and completeness of the combustion of the combustion gas.

The degree of completeness of combustion, the so-called burn-out, is dependent on the height above the burner at which maximum burn-out is achieved, that is to say that maximum burn-out is only achieved at a specific height above the burner. The trend of the burn-out as a function of the height above the burner may be imagined as a rising curve which approaches the maximum burn-out asymptotically.

SUMMARY OF THE INVENTION

An object of the invention is to improve combustion characteristics, in particular it is sought that the curve of the relationship of burn-out and height above burner, becomes steeper; in other words it is desired that the maximum burn-out is to be attained at a lower height above the burner or that a higher degree of burn-out of the combustion gas is to be attained at the same height above the burner.

In accordance with the invention there is provided a ceramic gas burner for a hot blast stove having a burner crown and gas and air ducts having respective discharge openings at said burner crown, said gas and air ducts comprising a central gas duct;

at least two side air ducts which have their said discharge openings at respectively opposite sides of said discharge opening of said central gas duct; and at least one central air duct having at least one said discharge opening within said central gas duct as seen in plan view. Suitably, the central gas duct extends vertically upwardly to its discharge opening, within the central gas duct.

It is preferable that the central air duct opens into central zone of the burner crown, at which the central gas duct and the side air ducts also open.

Preferably the central air duct provides a T-shape flow path for air, having an upwardly extending leg portion of the T-shape and at the top thereof arm portions of the T-shape extending laterally in opposite directions to respective discharge openings. With this design of the burner, a very intensive doubled air mixing is achieved, which leads to faster and better combustion of the gas. By "doubled" air mixing, we refer to the extra mixing effect of the supply of air centrally within the gas duct.

Also preferably the central air duct has a structure comprising an upwardly extending portion and at the top thereof a top portion projecting laterally in an overhanging manner at both of opposite sides of the upwardly extending portion, the top portion having opposite side faces at which the discharge openings of the central air duct are located. This top portion may thus project into the gas flow at a right angle. This achieves the effect that mixing is intensified still further because the gas eddies against and along the overhanging parts of the central air duct, which may deliberately not be streamlined, which again improves the effect of the doubled air mixing.

In one form of the ceramic burner in accordance with the invention, the central gas duct has an upwardly widening region at the said burner crown, the discharge opening or openings of the central air duct being located at the height of the lower end of the upwardly widening region. This can achieve the result that the mixing effects are enhanced yet further.

Preferably the side air ducts each have a plurality of discharge openings arranged in respective rows on opposite sides of the central gas duct, and as seen in plan view the central air duct has a plurality of discharge openings which are laterally directed and are arranged at locations which, in the longitudinal directions of the rows of the discharge openings of the side air ducts, are staggered relative to the locations of the discharge openings of the side air ducts. This is believed to make the mixing between gas and air still more intensive.

An effective structure of the ceramic burner in accordance with the invention is achieved when the burner has a structure comprising opposite outer side walls which bound the side air ducts and partition walls which separate the side air ducts from the central gas duct, and the burner crown has a structure which rests upon the side walls and the partition walls, there being cooperating tongue-and-groove constructions in the side walls and the partition walls on the one hand and the structure of the burner crown on the other hand, so as to locate the structure of the burner crown horizontally. This achieves the effect that the said partition wall is restrained from any inward movement without the flow being disturbed in the central zone.

A particular advantage is achieved with the burner in accordance with the invention if the burner is at least partly made of mold-cast concrete. This has been found to enable a considerable saving in construction costs.

The invention is also embodied in a method for operating the ceramic burner described above. Particularly, it is preferred that, of the total quantity of air supplied, 10%–20% is supplied via the central air duct, and the balance via the side air ducts on both sides of the central gas duct.

BRIEF INTRODUCTION OF THE DRAWINGS

An embodiment of the invention will now be described by way of non-limitative example with reference to the accompanying drawings.

DESCRIPTION OF THE PREFERRED EMBODIMENT

The positioning and operation of the burner in the combustion chamber of a hot-blast stove is well known and need not be explained in detail here.

Figure 1:
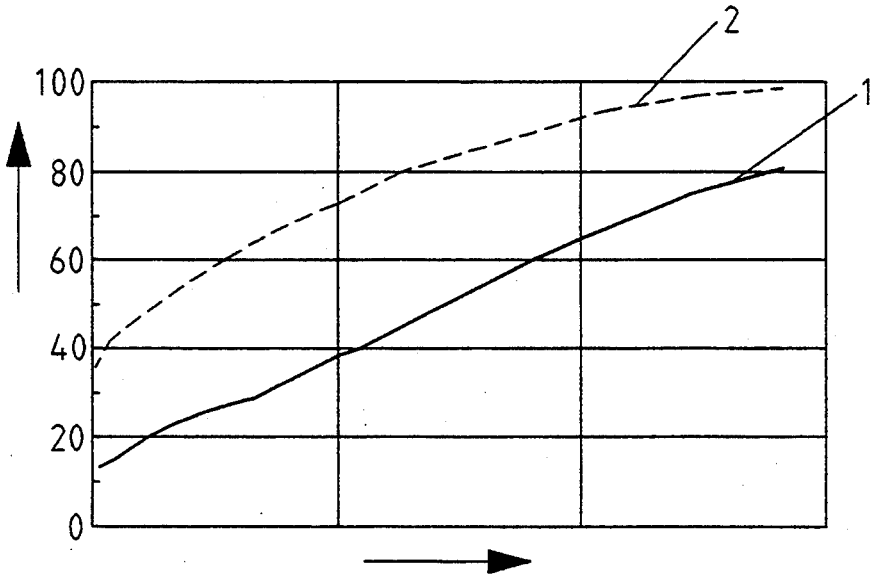
FIG. 1 shows the trend of the burn-out as a function of the height above the burner for the known burner of EP-A-0306072 and for the illustrated burner in accordance with the invention.

In FIG. 1, the horizontal axis represents the height above the burner and the vertical axis represents the burn-out as a percentage of complete combustion. Curve 1 represents the burn-out characteristic of the known burner of EP-A-0306072; curve 2 represents that of the illustrated burner in accordance with the invention. Because of the "double" air mixing achieved in the burner of the invention, the maximum burn-out attained is higher (closer to 100%) and a higher burn-out degree is attained at a lower height above the burner. The CO content of the combusted gases which can be achieved with the known burner at a maximum burn-out is of the order of magnitude of 5,000 ppm CO. With the illustrated burner in accordance with the invention this fraction may be reduced to approximately 100 ppm CO.

Figure 2:
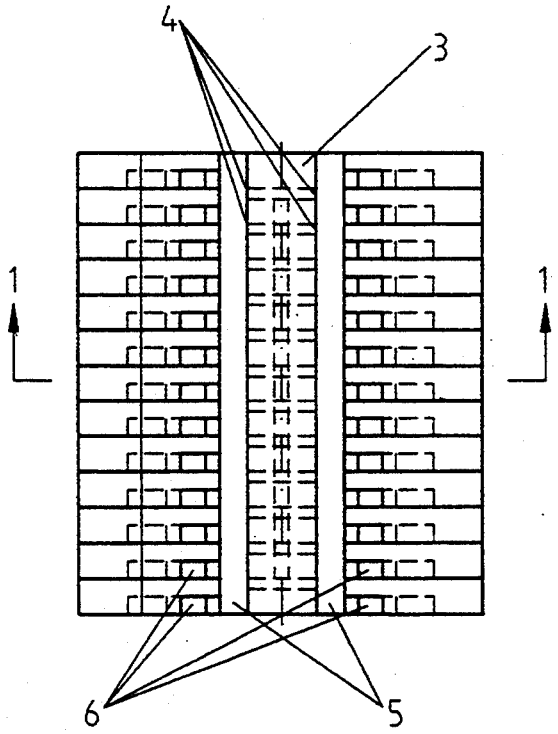
FIG. 2 shows the ceramic burner in accordance with the invention in top view.
Figure 3:
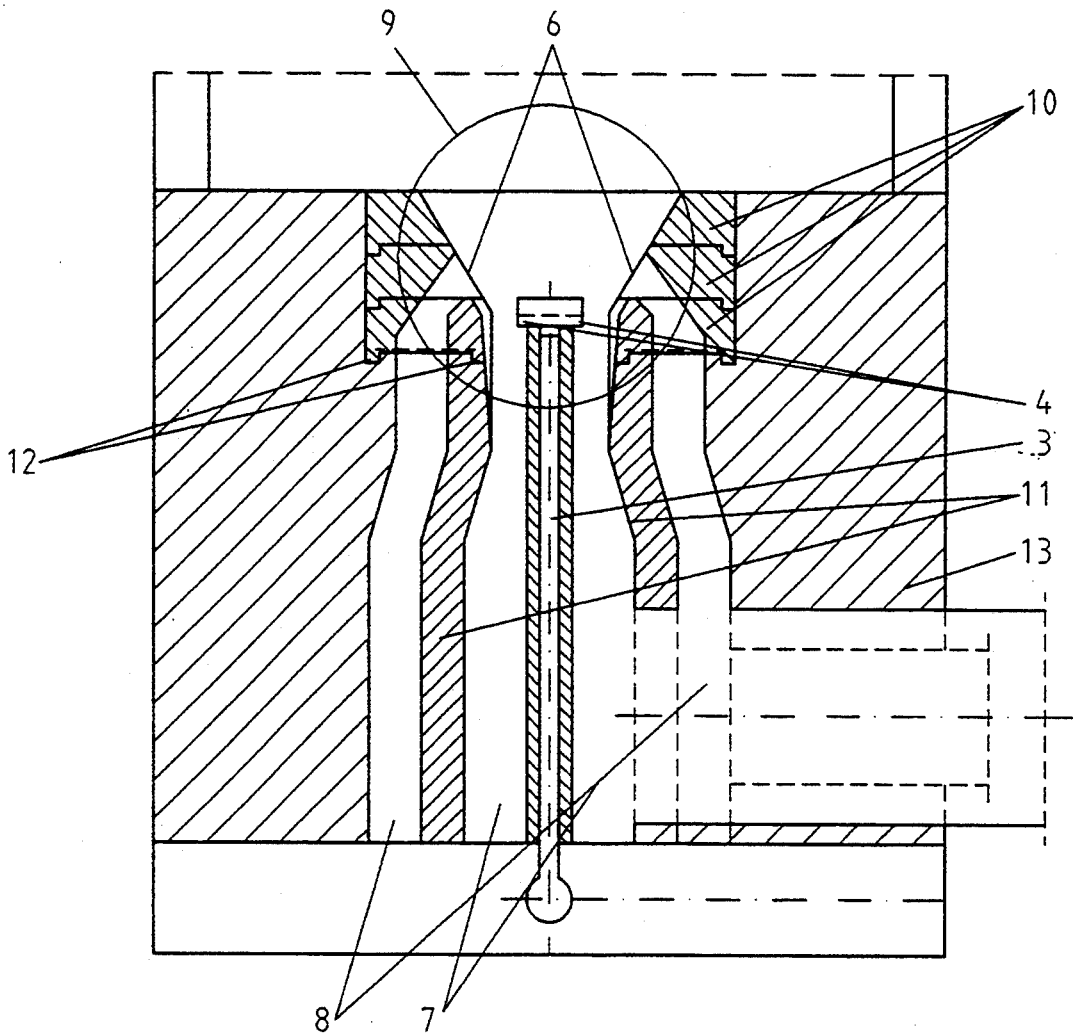
FIG. 3 shows a cross-section on line 1—1 in FIG. 2.

FIGS. 2 and 3 show the burner embodying the invention. The burner has a central gas duct 7 which opens at the central zone 9 of the burner crown. Side air ducts 8 each have a row of outlet openings 6, on opposite sides of the central gas duct 7. Within the central gas duct 7 there is a central air duct 3 which extends vertically upwardly to a top portion where the air flow direction is changed to horizontal, so that the air emerges laterally through outlets 4 into the gas flow. This gives the air flow a T-shape path in the central air duct. As seen in FIG. 2, the gas comes upwards through the gaps 5. As seen in plan view, from above, the outlets 4 are positioned between the respective openings 6 along each row of the latter i.e. the openings 4 and the openings 6 have staggered relative positions.

In FIG. 3 it can be seen that the side outlets 4 of the central air duct 3 are at the height where the gas duct 7 starts to widen upwardly.

Any tendency to inward movement of partition walls 11 separating the side air ducts 8 from the central gas duct 7 is countered by tongue-and-groove joins 12 on the abutting faces of the elements 10 of the burner crown and the abutting faces of the lowermost elements 10 and the supporting partition walls 11 and burner body 13. The burner body 13 and the partition walls 11 may be cast from a refractory concrete. The central air duct 3 is composed, in this example, of steel sections which have their outer edges bedded in concrete and their inner edges supply the central air flow. For the right-angled overhanging top part, a T-shaped beam may, for example, be fitted on the top of the vertical part of the central air duct.

The burner crown elements 10 consist of, in this example, three layers laid on top of each other. These elements have been pre-cast in a refractory concrete in molds.

To operate the burner a combustible gas is supplied to the gas duct 7 and the combustion air needed for combustion is supplied to the ducts 3 and 8, preferably in a proportion of 10% to 20% in the ducts 3 and 90% to 80% in the side ducts 8. Due to the fast and complete mixing the burner makes it possible, to reduce the height of the combustion chamber and to improve the burn-out of the combustion gas. With an air excess of 10% relative to the stoichiometrically required amount of air, the enhanced air mixing can reduce emission of CO by a factor of 50.

What is claimed is:

1. A ceramic gas burner for a hot blast stove having a burner crown and gas and air ducts having respective discharge openings at said burner crown, said gas and air ducts comprising a central gas duct;

at least two side air ducts which have their said discharge openings at respectively opposite sides of said discharge opening of said central gas duct; and at least one central air duct having at least one said discharge opening within said central gas duct, said side air ducts each having a plurality of said discharge openings arranged in respective rows on said opposite sides of said central gas duct, said central air duct having a plurality of said discharge openings which are laterally directed and are arranged at locations which, in the longitudinal directions of said rows of said discharge openings of said side air ducts, are staggered relative to the locations of said discharge openings of said side air ducts.

2. The ceramic as burner according to claim 1 wherein said burner crown has a central zone, said central air duct having its said at least one discharge opening at said central zone.

3. The ceramic gas burner according to claim 1 wherein said central gas duct extends vertically upwardly to its said discharge opening, said central air duct extending upwardly centrally within said central gas duct.

4. The ceramic gas burner according to claim 1 wherein said central air duct provides a T-shape flow path for air, having an upwardly extending leg portion of the T-shape and at the top thereof arm portions of the T-shape extending laterally in opposite directions to respective said discharge openings of said central air duct.

5. The ceramic gas burner according to claim 1 wherein said central air duct has a structure comprising an upwardly extending portion having opposite sides and at the top thereof a top portion projecting laterally in an overhanging manner at both of said opposite sides of said upwardly extending portion, said top portion having opposite side faces at which said discharge openings of said central air duct are located.

6. The ceramic gas burner according to claim 1 wherein said central gas duct has an upwardly widening region at said burner crown, said upwardly widening region having a lower end, said at least one discharge opening of said central air duct being located at a height of said lower end of said upwardly widening region.

7. The ceramic gas burner according to claim 1 wherein said burner has a structure comprising opposite outer side walls which bound said side air ducts and partition walls which separate said side air ducts from said central gas duct, and said burner crown has a structure which rests upon said side walls and said partition walls, there being cooperating tongue-and-groove constructions in said side walls and said partition walls on the one hand and said structure of said burner crown on the other hand, so as to locate said structure of said burner crown horizontally.

8. The ceramic gas burner according to claim 1 wherein said burner is at least partly made of mold-cast concrete.

* * * * *